United States Patent [19]

Lowe

[11] 4,309,853

[45] * Jan. 12, 1982

[54] FRAMELESS METAL BUILDING

[76] Inventor: Colin F. Lowe, 5518 Aspen, Houston, Tex. 77081

[ * ] Notice: The portion of the term of this patent subsequent to Sep. 9, 1997, has been disclaimed.

[21] Appl. No.: 969,342

[22] Filed: Dec. 14, 1978

Related U.S. Application Data

[63] Continuation-in-part of Ser. No. 931,854, Aug. 7, 1978, Pat. No. 4,221,087, which is a continuation-in-part of Ser. No. 831,781, Sep. 9, 1977, Pat. No. 4,106,245.

[51] Int. Cl.[3] ..... E04B 7/02

[52] U.S. Cl. ..... 52/90; 52/281; 52/537; 52/630

[58] Field of Search ..... 52/579, 802–805, 52/810, 630, 569, 588, 536, 537, 521, 86, 90, 463, 404, 281

[56] References Cited

U.S. PATENT DOCUMENTS

| | | | |
|---|---|---|---|
| 1,800,363 | 7/1931 | Sisson | 52/45 |
| 2,352,884 | 7/1944 | Brinker . | |
| 2,526,323 | 10/1950 | Blaski . | |
| 3,033,331 | 5/1962 | Behlen . | |
| 3,129,791 | 4/1964 | Gumucio et al. | 52/828 X |
| 3,190,404 | 6/1965 | Greulich . | |
| 3,203,145 | 8/1965 | Raynes | 52/90 X |
| 3,218,773 | 11/1965 | Heirich | 52/521 |
| 3,267,626 | 8/1966 | Daly | 52/805 |
| 3,300,923 | 1/1967 | Behlen | 52/86 X |
| 3,308,596 | 3/1967 | Cooper et al. | 52/630 |
| 3,492,765 | 2/1970 | Behlen | 52/630 X |
| 3,657,849 | 4/1972 | Garton | 52/537 X |
| 3,660,482 | 5/1972 | Elizalde | 52/537 |
| 3,820,295 | 6/1974 | Folley | 52/630 X |
| 3,902,288 | 9/1975 | Knudson | 52/86 |
| 3,959,942 | 6/1976 | Merson | 52/551 |
| 3,968,603 | 7/1976 | Merson | 52/574 X |
| 3,998,024 | 12/1976 | Frandsen | 52/404 X |
| 4,074,495 | 2/1978 | Bodnar | 52/630 X |
| 4,106,245 | 8/1978 | Lowe | 52/90 |

FOREIGN PATENT DOCUMENTS

| | | | |
|---|---|---|---|
| 214576 | 6/1956 | Australia | 52/90 |
| 529025 | 6/1954 | Belgium | 52/588 |
| 997117 | 9/1976 | Canada | 52/86 |
| 1017523 | 9/1977 | Canada | 52/86 |
| 815202 | 4/1937 | France | 52/588 |
| 50008 | 9/1921 | Sweden | 52/630 |
| 478484 | 1/1938 | United Kingdom . | |

*Primary Examiner*—Alfred C. Perham
*Attorney, Agent, or Firm*—Jacox & Meckstroth

[57] ABSTRACT

A series of rectangular roof panels and rectangular wall panels each include inner and outer corrugated sheet metal skins or skin portions which are rigidly secured by fasteners to opposite sides of formed sheet metal longitudinally extending spacer members rigidly connected by formed sheet metal laterally extending spacer members. A formed sheet metal box-type or fabricated ridge beam and a series of fasteners rigidly connect the inner skin portions and spacer members of the roof panels on opposite sides of the ridge to transmit tension forces, and a compressive wedge and fasteners rigidly connect the outer skin portions, and spacer members of the roof panels for transmitting compression forces. Inclined inner attachment plates and fasteners rigidly connect the inner skin portions and spacer members of the roof panels to the inner skin portions and spacer members of the wall panels, and outer attachment plates and fasteners rigidly connect the spacer members of the roof panels to the outer skin portions and spacer members of the wall panels to form a building structure which has substantial total strength and can be easily and quickly erected without the use of a crane. In some buildings, each of the roof and wall panels may also be formed from a single metal sheet which forms inner skin portions and outer skin portions connected by integral right angle side or web portions, and each panel may have a Z-shaped lateral configuration. Longitudinally spaced and laterally extending sheet metal spacers connect the outer skin portions to the side or web portion of each panel, and longitudinally spaced and laterally extending elongated tie members rigidly connect the inner skin portions of all the assembled panels.

12 Claims, 21 Drawing Figures

FRAMELESS METAL BUILDING

RELATED APPLICATION

This application is a continuation-in-part of U.S. Pat. application Ser. No. 931,854, filed Aug. 7, 1978, now U.S. Pat. No. 4,221,087 which is a continuation-in-part of U.S. patent application Ser. No. 831,781, filed Sept. 9, 1977, now U.S. Pat. No. 4,106,245.

BACKGROUND OF THE INVENTION

In the art of metal buildings, it is common to use a steel frame which provides for a low roof pitch and for resisting the loads on the building. Parallel spaced roof purlins and parallel spaced wall girts are secured to the frame, and corrugated sheet metal skins or panels are attached to the outer surfaces of the roof purlins and wall girts to form the outer covering or shell for the building. Usually the outer metal skin or sheet metal panels are corrugated in order for the panels to span the spaces between adjacent roof purlins and wall girts, but the frame supports substantially the entire static, wind and snow loads on the metal building.

There have been attempts to construct metal buildings without a metal frame, purlins and girts and to use the inherent strength of corrugated roof and wall panels to withstand the various loads on the building. Examples of such building constructions are disclosed in U.S. Pat. Nos. 2,742,114 and No. 3,492,765. It has also been proposed to construct a metal building without the use of purlins and girts by erecting a frame and attaching to the frame heavy corrugated sheet metal panels, for example, as disclosed in U.S. Pat. No. 3,308,596. The construction of a metal building has also been proposed from prefabricated roof and wall panels each of which includes inner and outer corrugated sheet metal skins tied together by braces or bars, for example, as disclosed in U.S. Pat. Nos. 3,064,771 and 3,500,596. Corrugated sheet metal panels have also been used or proposed to form a single skin sheet metal building, for example, as disclosed in above mentioned U.S. Pat. No. 3,492,765 and in U.S. Pat. Nos. 3,156,070; 3,568,388; 3,657,849; 3,959,942 and 3,968,603.

SUMMARY OF THE INVENTION

The present invention is directed to an improved sheet metal building structure formed of prefabricated sheet metal panels constructed and assembled in a manner which provides for substantially high total strength and thus high resistance to wind and snow loads, and which eliminates the need for a metal frame, roof purlins and wall girts. In addition, the metal building of the present invention significantly reduces the total time and cost for constructing and erecting a metal building and, in addition, eliminates the need for a crane to erect the building. The construction of the prefabricated sheet metal panels and the manner by which the panels are coupled together further provides for fast, simple and accurate erection of a metal building and utilizes the inherent strength of the sheet metal inner and outer skins or skin portions of the panels to support or carry substantially the entire loads which are applied to the building as a result of various weather conditions.

Other features and advantages of the invention will be apparent from the following description, the accompanying drawings and the appended claims.

DESCRIPTION OF THE PREFERRED EMBODIMENT

Figure 1:
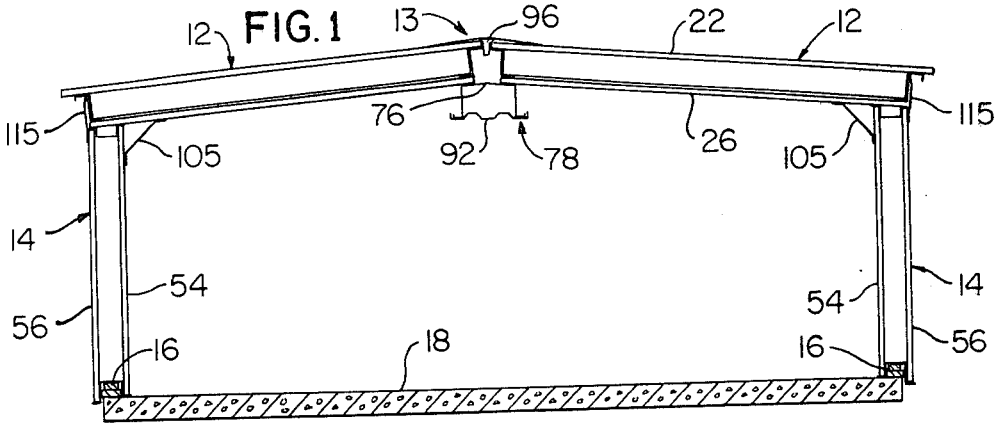
FIG. 1 is an end elevational view of a sheet metal building constructed in accordance with the invention and with the end walls removed.

A metal building constructed in accordance with the invention has an end view as generally illustrated in FIG. 1 and includes a plurality of prefabricated rectangular roof panels 12 which are coupled together along the center ridge 13 of the building and which are coupled together and supported by a plurality of prefabricated rectangular side wall panels 14 and end wall panels (not shown). The vertical side and end wall panels seat upon base floor plates 16 which are bolted to the outer edges of a concrete slab floor 18.

Figure 2:
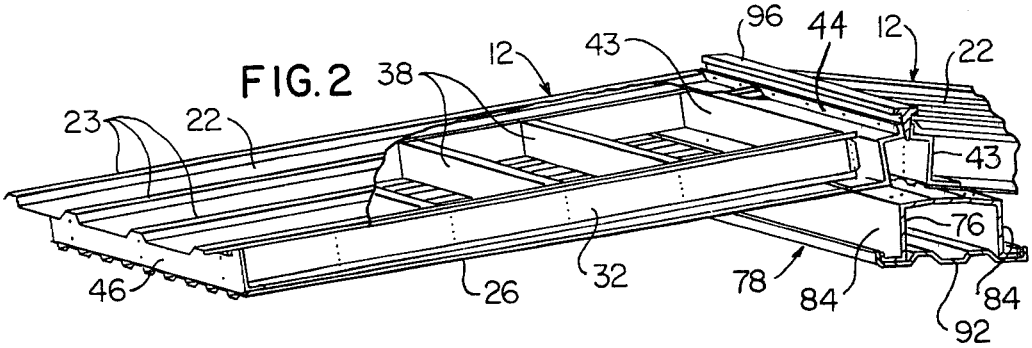
FIG. 2 is a fragmentary perspective view of two opposing roof panels used in the building shown in FIG. 1 and illustrating the system for coupling the roof panels along the ridge of the building.
Figure 7:
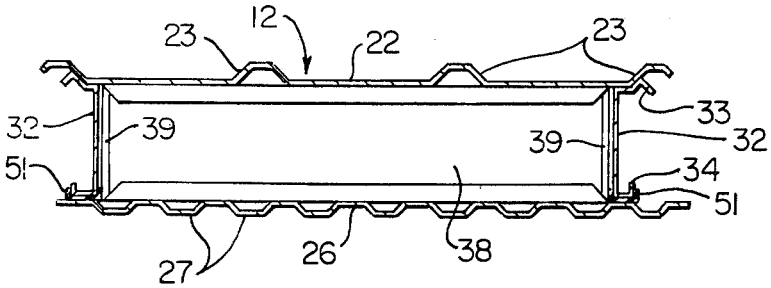
FIG. 7 is an enlarged cross-section of a typical roof panel shown in FIG. 2.

Each of the prefabricated roof panels 12 is constructed of formed sheet metal and includes an upper or outer sheet metal skin 22 (FIGS. 2 and 7) having parallel spaced roll-formed ribs 23. Each roof panel 12 also includes a lower or inner sheet metal skin 26 (FIG. 7) which forms an inner liner for the building and also has parallel spaced ribs 27 to provide a corrugated cross-sectional configuration. As illustrated in FIG. 1, the thicknesses of the roof panels 12 and the wall panels 14 are somewhat exaggerated relative to the size of the metal building.

The roll-formed sheet metal skins 22 and 26 of each roof panel 12 are rigidly secured by blind rivets (not shown) such as "Pop" rivets to parallel spaced longitudinally extending spacer members 32 (FIG. 7) which are formed of sheet metal and have generally a channel-shaped configuration. The upper flange of each spacer member 32 has a V-shaped rib portion 33 which is secured by rivets to an adjacent rib 23 of the overlying outer skin 22, and the lower flange of each spacer member 32 has an inwardly projecting return rib portion 34 and is secured by rivets to the inner sheet metal skin 26.

The longitudinally extending spacer member 32 of each roof panel 12 are rigidly connected by laterally extending spacer members 38 (FIGS. 2 and 7) each of which is also formed of sheet metal and has opposite end flanges 39 (FIG. 7) secured by rivets to the spacer members 32. The upper and lower flanges of each laterally extending spacer member 38 has inwardly projecting rib portions 41. The upper or inner ends of the longitudinally extending spacer members 32 of each roof panel 12 are also rigidly secured by a ridge spacer member 43 (FIG. 4) which has generally a Z-shaped cross-sectional configuration with an upwardly projecting flange 44. The outer or lower ends of the longitudinally extending spacer members 32 of each roof panel 12 are rigidly connected by an eave spacer member 46 (FIG. 5) which also has a Z-shaped cross-sectional configuration and includes a downwardly projecting return lip portion 47. All of the spacer members 32, 38, 43 and 46 of each roof panel 12 are formed of sheet metal and are rigidly secured by rivets to the upper or outer skin 22 and lower or inner skin 26 to form, in effect, a box beam. A channel shaped strip 51 (FIGS. 5 and 7) of thermal insulation material is sandwiched between the lower surfaces of each of the spacer members and the inner skin 26 to avoid any significant heat transfer between the inner skin 26 and the outer skin 22.

Figure 3:
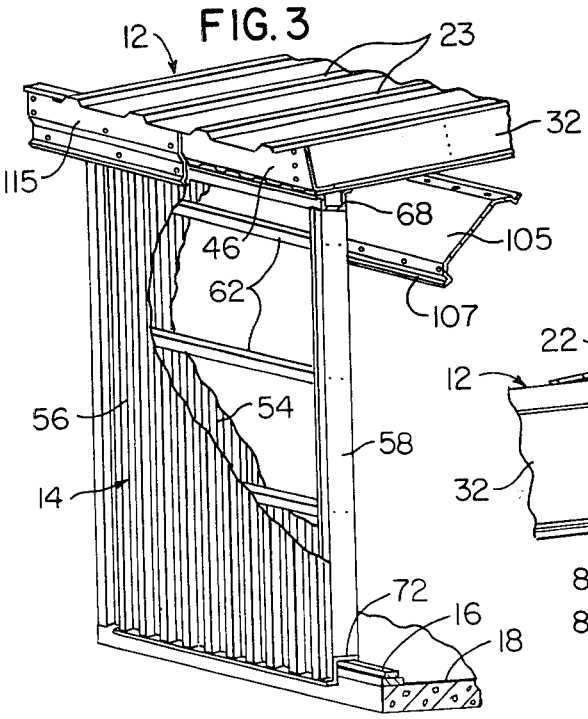
FIG. 3 is a fragmentary perspective view of the wall and roof panels used in the building shown in FIG. 1 and illustrating the coupling of the roof panels to the wall panels.
Figure 8:
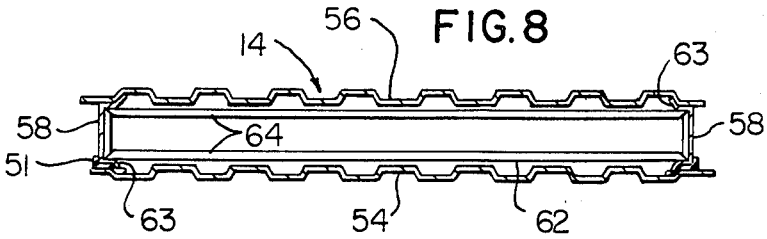
FIG. 8 is an enlarged cross-section of a typical wall panel as shown in FIG. 3.

Each of the side wall panels 14 is constructed or fabricated substantially the same as the roof panels 12. Thus referring to FIGS. 3 and 8, a rectangular wall panel 14 includes a corrugated or ribbed inner sheet metal skin 54 and a ribbed sheet metal outer skin 56 which are secured by rivets to a set of vertical or longitudinally extending sheet metal spacer members 58. The spacer members 58 are rigidly connected by horizontal or laterally extending sheet metal spacer members 62. As shown in FIG. 8, each of the longitudinally extending spacer members 58 has generally a channel-shaped configuration with outwardly projecting lip portions 63 which are riveted to the roll-formed inner and outer skins. Each of the laterally extending spacer members 62 is constructed similar to the spacer members 38 and has inwardly projecting return lip portions 64. The spacer members 62 also have end flanges 66 which are secured by rivets to the parallel spaced longitudinally extending spacer members 58 of the wall panel.

Figure 5:
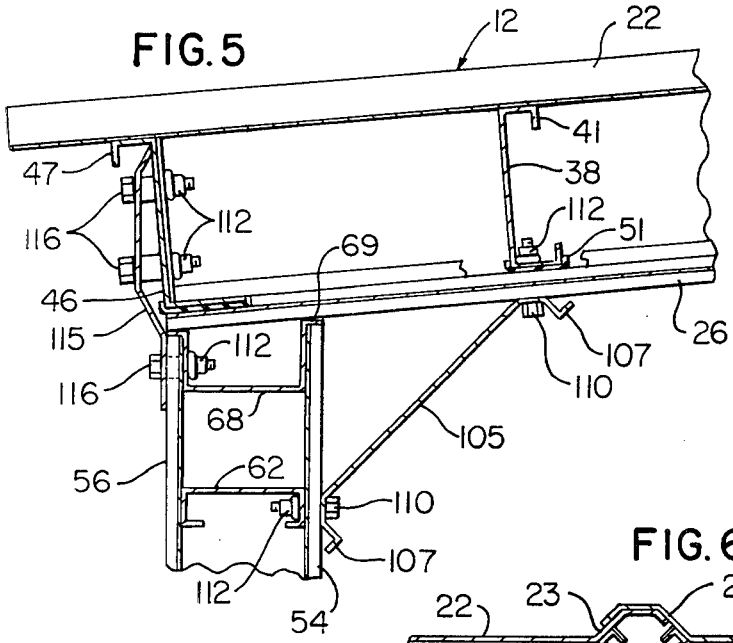
FIG. 5 is an enlarged vertical section through an eve portion of the building shown in FIG. 1.

Referring to FIG. 5, the upper ends of the inner and outer skins of the wall panel 14 forming each side wall are rigidly connected by a channel-shaped horizontal spacer member 68 which has outwardly projecting lip portions 69 overlying the upper ends of the inner and outer skins 54 and 56. The top spacer member 68 is formed in sections and extends continuously the full length of the building and cooperates to align the wall panels. A similarly shaped channel-like spacer member 72 (FIG. 3) rigidly secures the lower end portions of the inner and outer skins of each wall panel 14 and receives the plate member 16 secured to the floor 18. While not shown, the end wall panels for the metal building are constructed substantially the same as the side wall panels 14, except that the end wall panels have a greater length or height and have upper ends which conform to the pitch of the building roof. One or both of the end walls may be provided with a large door opening according to the ultimate use of the metal building.

Figure 6:
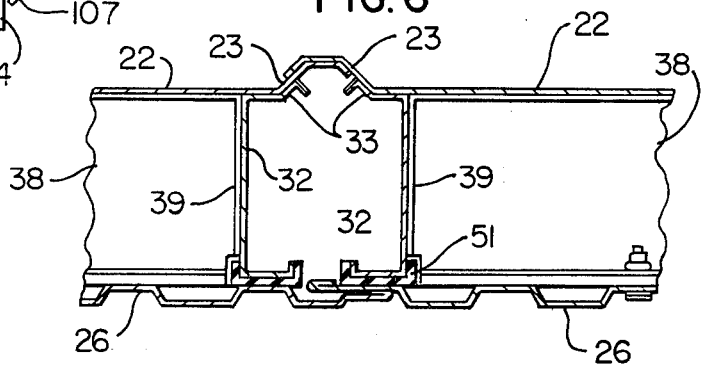
FIG. 6 is an enlarged fragmentary section showing the assembled relation of two adjacent roof panels.

In the erection of a metal building in accordance with the invention, two or more side wall panels 14 are placed upon the floor plate 16 on each side of the building, and the overlapping skins of the wall panels are secured together by fasteners such as screws or blind rivets. The wall panels for one end of the building are also erected and connected to each other and to the adjacent side wall panels 14 at the corners of the building. A set of opposing roof panels 12 are positioned in place, and the inner end portions of the roof panels 12 are rigidly connected by the top plate or ridge member 76 (FIG. 4) of a ridge beam 78. The connection is formed by a set of bolts 81 which are longitudinally spaced along the ridge spacer member 43 and extend through the ridge spacer member and lower roof skin 26 of each roof panel 12 in addition to the ridge beam plate 76. Some of the bolts 81 also extend through the longitudinal spacer members of each roof panel. Thus the bolts 81 and plate 76 form a rigid connection between each set of opposing roof panels 12 along the ridge 13 and provide for transmitting substantial tension forces between the roof panels across the ridge. The next pair of opposing roof panels 12 are assembled, and the skins of adjacent roof panels overlap as shown in FIG. 6. The overlapping ribs of the skins are secured together by fasteners such as screws and/or blind rivets.

The ridge beam 78 also includes downwardly projecting side walls 84 (FIG. 4) and outwardly projecting bottom flanges 86, and is constructed in longitudinal sections which are coupled together as the erection of the building progresses from one end of the building towards the opposite end. The side walls of the ridge beam 78 are also coupled together at longitudinally spaced intervals by rectangular ridge beam spacers 88 which are also formed of sheet metal and are secured to the side walls by rivets. The ridge beam 78 is also connected to opposite end walls of the building, and after the building is erected and the bolts 81 are completely tightened, a bottom sheet metal ridge beam cover 92 is secured to the bottom flanges 86 and cooperates to complete the ridge beam 78 in the form of a box beam.

After all of the roof panels 12 are erected and coupled together by the top plate 76 of the ridge beam 78, and the outer end portions of the roof panels 12 are coupled to the side walls 14, as will be explained later, a tapered wedge member 96 (FIG. 4) is inserted between the upwardly projecting flanges 44 of the ridge spacer members 43 of the roof panels 12, and sections of the wedge member 96 extend continuously the full length of the building. After the wedge member 96 is positioned so that it forms a snug fit between the flanges 44, the wedge member 96 is drilled with holes which align with preformed holes within the flanges 44, and a series of bolts 98 are inserted through the holes to secure the wedge member in place. Thus the wedge member 96 functions to transfer compression forces between the upper or outer skins 22 of opposing sets of roof panels 12 across the ridge 13 and also functions to compensate for accumulated tolerance in the manufacture and assembly of the roof panels. A ridge cover plate 102 is placed over the wedge member 96 and is secured by screws to the outer skins 22 of the roof panels 12.

Referring to FIG. 5, the outer end portion of each roof panel 12 seats upon the upper header and spacer member 68 which connects the upper ends of the side walls panels 14 of each side wall. An inner attachment plate 105 slopes at an angle of approximately 45 degrees between the inner skins of the roof panels 12 and wall panels 14, and the inner attachment plate 105 is formed in longitudinal sections in a manner similar to the ridge beam 78 and wedge member 96. V-shaped ribs 107 are formed along opposite edge portions of each attachment plate 105 for purpose of reinforcement, and the attachment plates may be ribbed or corrugated at longitudinally spaced intervals to provide additional compression strength.

The upper edge portion of each attachment plate 105 is rigidly secured to the roof panels 12 by a series of longitudinally spaced screws 110 each of which is threaded into a preassembled nut 112, preferably in the form of a "Rivnut" manufactured and marketed by The B. F. Goodrich Company. Each "Rivnut" extends through the inner skin 26 and a laterally extending spacer member 38 and secures these components together. Some of the "Rivnuts" also extend through the longitudinally extending spacer members 32 of the roof panels.

The lower edge portion of each inner attachment plate 105 is also rigidly connected to the side wall panels 14 by another set of screws 110. Each screw is threaded into an aligned "Rivnut" 112 which connects the overlapping portions of the longitudinally extending or vertical spacer members 58 and the uppermost laterally extending or horizontal spacer member 62 of each wall panel.

As also shown in FIG. 5, a laterally extending outer attachment plate 115 couples the outer end portions of the roof panels 12 to the upper end portions of the side wall panels 14, and is also formed in longitudinally continuous sections. The upper portion of each section of the outer attachment plate 115 is connected by bolts 116 to "Rivnuts" 112 secured to the overlapping portions of the eave spacer member 46 and end flanges of the longitudinal spacer members 32 of each roof panel 12. The lower portion of each section of the outer attachment plate 115 is secured by bolts 116 which are threaded into "Rivnuts" 112 secured to overlapping portions of the spacer members 58 and 68 of each wall panel 14 and to the outer skin 56.

Figure 9:
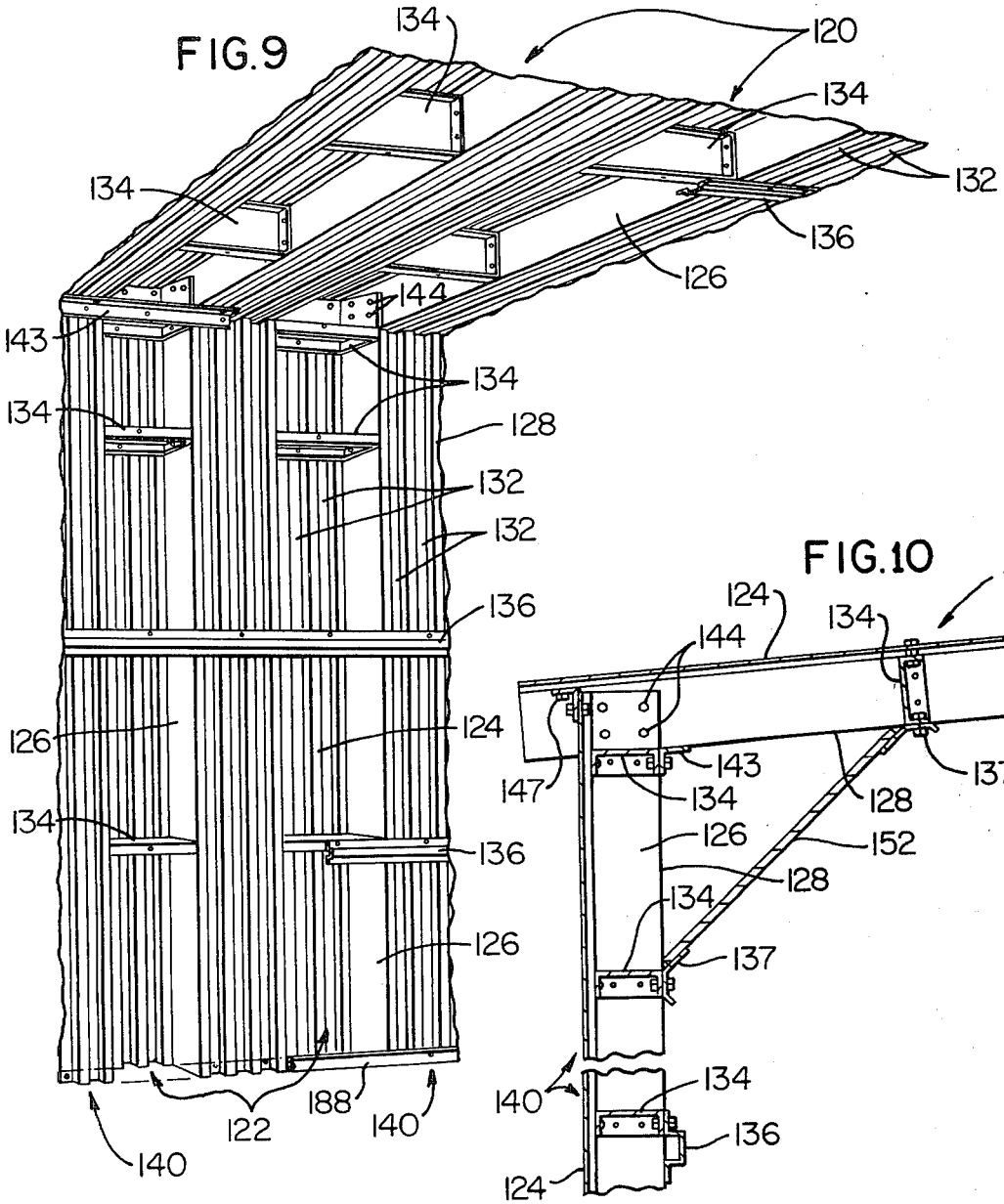
FIG. 9 is an inside perspective view of a portion of a single skin sheet metal building constructed in accordance with another embodiment of the invention.
Figure 10:
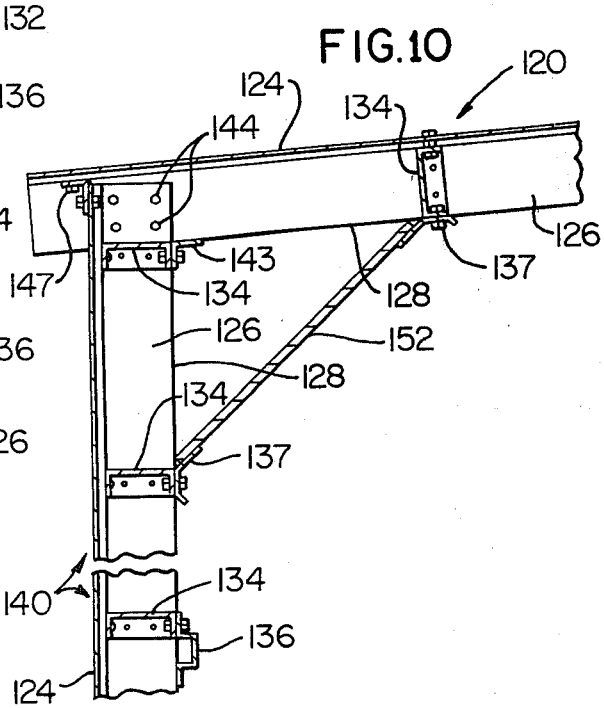
FIG. 10 is a fragmentary vertical section similar to FIG. 5, of the eve portion of the building embodiment shown in FIG. 9.
Figure 11:
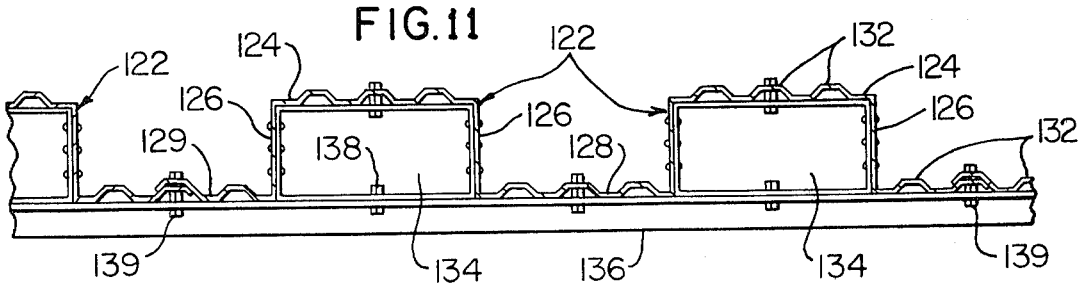
FIG. 11 is a fragmentary lateral section through the assembly of adjacent wall or roof panels used in the building embodiment of FIG. 9.

Referring to FIGS. 9–12, a frameless metal building is constructed in accordance with the invention using a plurality or series of assembled roof panels and wall panels each of which is basically formed from a single metal sheet, with the roof and wall panels having substantially the same construction. Thus as shown in FIGS. 9–11, a plurality of roof panels 120 are each constructed by roll forming a metal sheet to produce parallel spaced and longitudinally extending primary corrugations 122 (FIG. 11). Each primary corrugation 122 is formed by an outer skin portion 124 which integrally connects parallel spaced side wall portions 126. Each of the roof panels 120 also includes inner skin portions 128 and 129 which either connect or extend from the side wall portions 126. Each of the outer skin portions 124 and each of the inner skin portions 128 and 129 includes a plurality of longitudinally extending secondary corrugations 132 which project outwardly of the building in the same direction as the primary corrugations 122, but are substantially smaller than the primary corrugations.

The side wall portions 126 of each primary corrugation 122 are rigidly connected by a plurality of longitudinally spaced spacer members 134. Each spacer member 134 is formed from sheet metal and has peripherally extending border flanges which are secured or fastened to the side wall portions 126 and to the outer skin portion 124 of the corresponding primary corrugation 122. After the roof panels 120 are assembled as illustrated in FIG. 9, the inner skin portions 128 and 129 of the roof panels are rigidly connected to a series of longitudinally spaced and laterally extending tie members 136 (FIG. 11) and 137 (FIG. 10). As illustrated, the tie members 136 and 137 are formed of sheet metal and are secured to the spacer members 134 by fasteners 138 and to the inner skin portions 128 and 129 by fasteners 139.

In the metal building embodiment illustrated in FIGS. 9–14, the assembled roof panels 120 are supported by side wall panels 140 which are constructed substantially the same as the roof panels 120. Accordingly, the reference numbers used above for the components of the roof panels are also used to identify the same components of the wall panels. Referring to FIG. 10, the assembled side wall panels 140 have upper end portions which are notched so that the primary corrugations 122 of each wall panel 140 projects upwardly into the corresponding primary corrugations 122 of the overlying roof panels 120. The roof panels 120 and side wall panels 140 are rigidly connected along the eave portions of the building by an inner elongated tie member 143 which extends longitudinally of the building, with fasteners 144 connecting the adjacent side wall portions 126 of the interfitting roof panels 120 and side wall panels 140.

The outer skin portions 124 of the roof panels 120 and side wall panels 140 are also rigidly connected within each primary corrugation 122 of the panels by an angular shaped outer tie member 147 (FIG. 10) and corresponding fasteners. As also illustrated in FIG. 10, the assembled roof panels 120 are rigidly connected to the assembled side wall panels 140 of each side wall by an inclined corrugated sheet metal brace member or panel 152 which extends the length of the building along the eave portion. Each brace panel 152 is rigidly connected to the laterally extending tie members 137 within the roof panels 120 and within the side wall panels 140.

Figure 12:
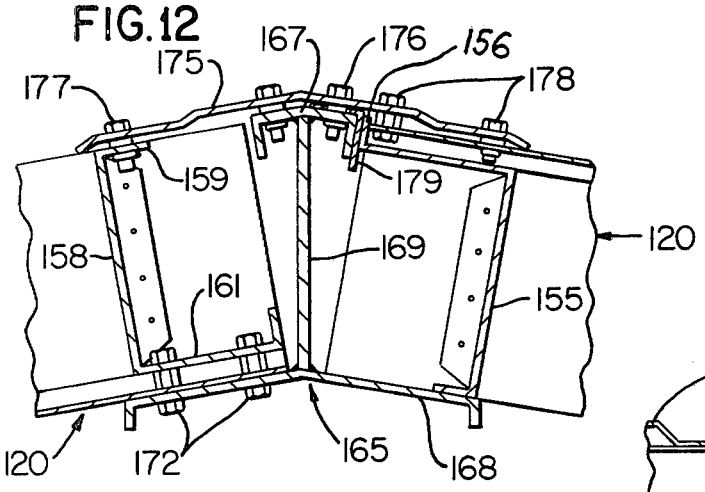
FIG. 12 is a fragmentary vertical section, similar to FIG. 4, through the ridge portion of the building embodiment shown in FIG. 9.

Referring to FIG. 12, a formed generally L-shaped metal spacer member 155 extends laterally within each primary corrugation 122 of each roof panel 120 and includes an upper flange portion 156 which abuts the upper or inner end of the adjacent outer skin portion 124 of the corrugation. A similarly formed metal spacer member 158 extends externally between the side wall portions 126 of each pair of adjacent primary corrugations 122 of the roof panels 120 and includes an upper flange portion 159 and a lower flange portion 161. All of the spacer members 155 and 158 are rigidly secured by fasteners to the adjacent side wall portions 126 of the roof panels 120.

A ridge beam 165 (FIG. 12) extends the length of the building and includes an upper flange portion 167 and a lower flange portion 168 rigidly connected by a vertical web portion 169. The inner end portions of the roof panels 120 seat on the bottom flange portion 168 of the ridge beam 165, and fasteners 172 connect the bottom flange portion 168 of the ridge beam to the inner skin portions 128 and 129 of the roof panels and to the bottom flange portions 161 of the spacer members 158. A ridge cover member or plate 175 overlies the inner end portions of the assembled roof panels 120 and extends the length of the building. The ridge plate is connected by fasteners 176 to the upper flange 167 of the ridge beam 165 and is also connected by fasteners 177 to the upper flange portion 159 of the spacer members 158 which are located in an alternating manner on opposite sides of the ridge beam 165. Another set of fasteners 178 also connect the ridge plate member 175 to the outer skin portions 124 of the roof panels 120.

A filler or spacer strip 179 extends between the upper flange portion 156 of each spacer member 155 and the opposing upper flange portion 167 of the ridge beam 165. Thus the upper flange portion 167 of the ridge beam 165 and the ridge plate 175 cooperate with the fasteners to transmit compression forces across the upper part of the ridge portion and between the roof panels 120 located on opposite sides of the ridge beam 165. The lower flange portion 168 of the ridge beam 165 and the fasteners 172 connected to the inner skin portions 128 and 129 and spacer members 134 of the roof panels function to transmit tension forces across the lower part of the ridge and between the lower or inner skin portions of the roof panels 120.

Figure 13:
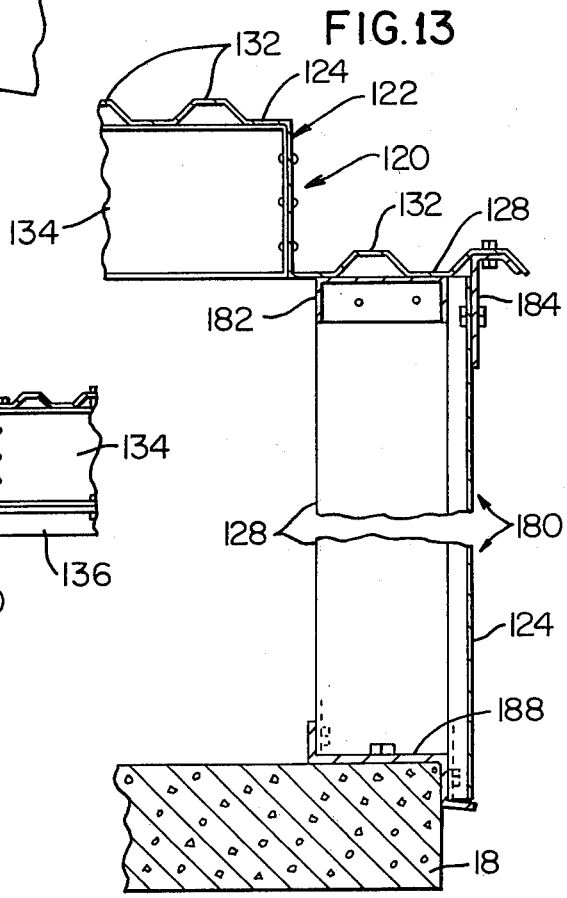
FIG. 13 is a fragmentary vertical section through the assembly of a roof panel and an end wall panel of the building embodiment shown in FIG. 9.

FIG. 13 illustrates the connection of a typical roof panel 120 to a typical end wall panel 180 which is constructed substantially the same as a side wall panel 140 except that the upper end surface of each end wall panel 180 is inclined to mate with the slope or pitch of the roof panels 120. Preferably, this pitch of the roof panels 120 is less than 17 degrees, for example, on the order of 10 degrees. Since the end wall panels 180 are constructed substantially the same as the roof panels described above, the same reference numbers are used for common components.

Figure 14:
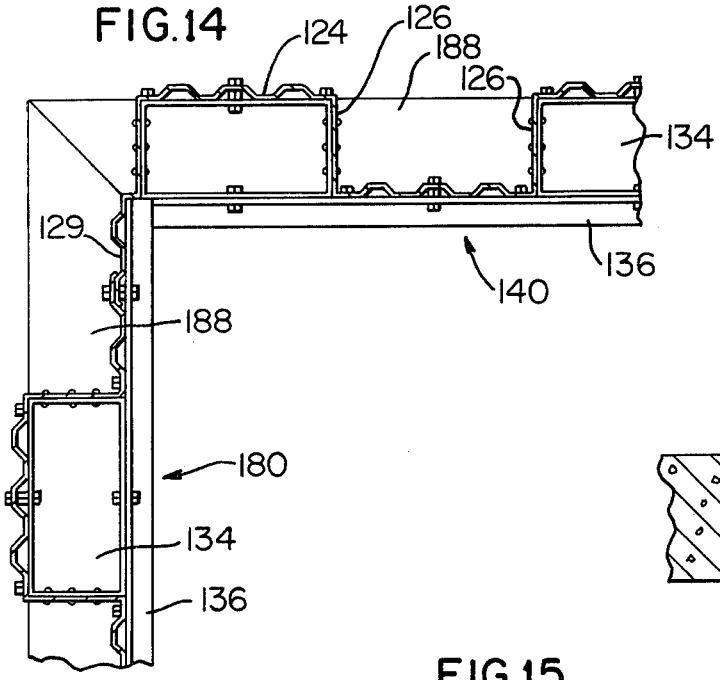
FIG. 14 is a fragmentary horizontal section through the wall panels forming a corner of the building embodiment shown in FIG. 9.

A series of channel-spaced spacer members 182 extend between the side wall portions 126 of each primary corrugation 122 of each end wall panel 180, and an external angle strip or plate 184 connects the outer skin portions 124 of each end wall panel 180 to the inner skin portion 129 of the overlying roof panel 120. As shown in FIGS. 9 and 13, the bottoms of the side wall panels 140 and the end wall panels 180 seat on corresponding formed metal base plates 188 which are secured to the upper surface of the supporting foundation or concrete floor 18. A typical corner connection of an end wall panel 180 and a side wall panel 140 is illustrated in FIG. 14. At each corner, an inner, skin portion 129 of the corner side wall panel 140 is formed at right angles around the corner and connects with the inner skin portion 129 of an end wall panel 180.

Figure 15:
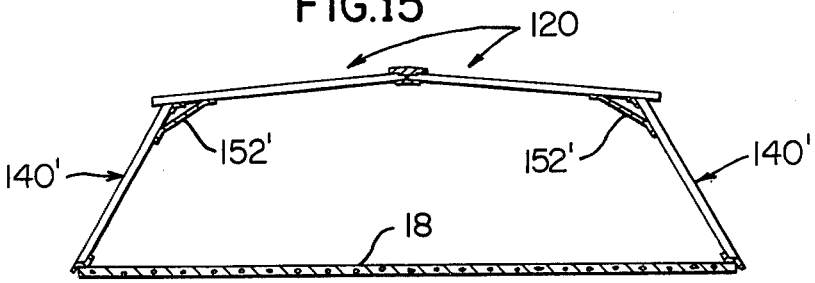
FIG. 15 is a vertical section similar to FIG. 1, through a modified single skin metal building constructed in accordance with the invention and with the end walls removed.

The "single skin" panel building described above in connection with FIGS. 9–14 is shown with assembled vertical side wall panels 140 and assembled vertical end wall panels 180. However, in reference to FIG. 15, it is within the scope of the invention to incline the assembled wall panels, for example, to incline the side wall panels 140' so that the opposite side walls converge towards the top or roof of the building. This results in the use of shorter rectangular roof panels 120' and wider brace panels 152'. Such a building configuration with inclined or tapering side wall is particularly suited for use in storing grains. The side and end wall panels may also be provided with separate sheet metal inner skins which extend at least partially up the walls to prevent the grain from filling the channels defined by the primary corrugations 122.

Figure 16:
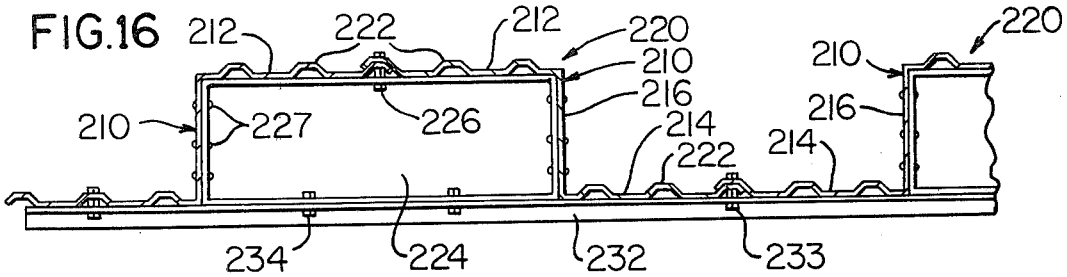
FIG. 16 is a fragmentary section similar to FIG. 11 and showing a modified panel constructed and assembled in accordance with the invention to form a single skin metal building or panel assembly.

FIG. 16 shows another panel assembly which is constructed in accordance with the invention and which may be used for the roof assembly and/or wall assembly of a "single skin" frameless metal building as described above in connection with FIGS. 9–14. The panel assembly shown in FIG. 16 includes a series of Z-shaped panels 210 each of which is roll-formed from an elongated metal sheet to form an outer skin portion 212 and an inner skin portion 214 integrally connected by a side wall or web portion 216. The web portion 216 of each panel 210 forms a right angle or is perpendicular to each of the skin portions 212 and 214 to provide the panel with generally a Z-shape lateral cross-sectional configuration.

The panels 210 are successively assembled at the building site by inverting alternate panels end-for-end so that the panels 210 cooperate to form parallel spaced and longitudinally extending primary corrugations 220. Each primary corrugation 220 is formed by the overlapping outer skin portions 212 of each pair of adjacent panels 210, and the web portions 216 of the adjacent panels 210 form the side walls of the primary corrugation. As also shown in FIG. 16, the outer skin portion 212 and the inner skin portion 214 of each Z-shaped panel 210 includes a series of parallel spaced and longitudinally extending secondary corrugations 222 which project outwardly with respect to the building.

In a manner as described above in connection with FIG. 11, a plurality of spacer members or panels 224 are positioned within each primary corrugation 220 at longitudinally spaced intervals, and each spacer panel is secured to the overlapping outer skin portions 212 of the adjacent panels 210 by fasteners 226, and fasteners 227 secure the spacer panel to the web portions 216 forming the side walls of the corrugation 220. The assembled panels 210 are also secured together after assembly by a series of longitudinally spaced and laterally extending tie members 232 which are secured to the inner skin portions 214 of the panels 210 by fasteners 233 and to the spacer panels 224 by fasteners 234.

Figure 17:
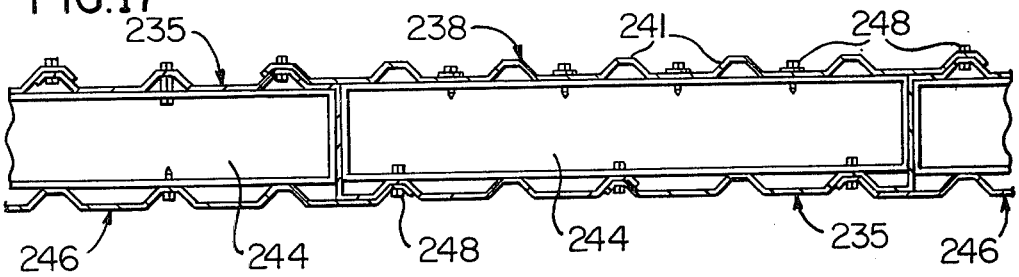
FIG. 17 is a fragmentary section similar to FIG. 16 and showing a modification which forms a double skin metal building or panel assembly.

Referring to FIG. 17, a "double skin" roof and/or wall panel assembly is constructed by successively assembling a series of Z-shaped panels 235 which are constructed substantially the same as the panels 210 described above in connection with FIG. 16. The primary corrugations formed by the panels 235 are then connected by series of generally flat sheet metal outer skin panels 238 which span the gaps between the primary corrugations. Each of the panels 238 has longitudinally extending secondary corrugations 241 which match the secondary corrugations on the outer skin portions of the panels 235 and provide the outer generally flat surface of the building with a uniform appearance.

A series of longitudinally spaced spacer members or panels 244 extend between each outer skin panel 238 and the inner skin portions of each pair of adjacent panels 235, and a series of longitudinally spaced spacer panels 244 are inserted within each of the primary corrugations formed by the assembled panels 235, in the same manner as the spacer panels 224 described above in reference to FIG. 16. In place of the laterally extending tie members 232, the primary corrugation formed by each pair of assembled panels 235 is closed by a sheet metal inner skin panel 246 which is roll formed in the same manner as each outer skin panel 238 and spans the gap formed by the primary corrugation. A series of fasteners 248 secure the panels 235, 238 and 246 to the spacer members or panels 244 so that the Z-shaped panels 235 cooperate with the generally flat panels 238 and 246 to form a "double skin" panel assembly which may be used in place of the "double skin" panel assemblies described above in connection with the embodiment shown in FIGS. 1–8.

Figure 18:
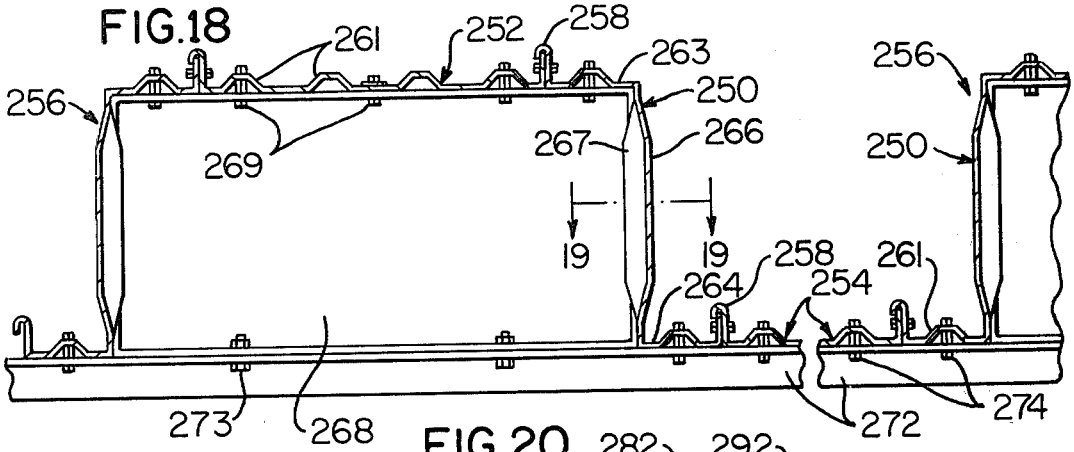
FIG. 18 is a fragmentary section similar to FIG. 16 and showing another single skin embodiment.

Referring to FIG. 18 which shows another form of "single skin" panel assembly constructed in accordance with the invention, a series of Z-shaped sheet metal panels 250 are assembled in the field in opposing relation and are interconnected by generally flat outer skin panels 252 and inner skin panels 254 to form parallel spaced primary corrugations 256. The edge portions of the panels 250, 252 and 254 are connected by "standing seam" joints 258 in place of the joints of overlapping corrugations as shown in FIGS. 16 and 17. All of the panels 250, 252 and 254 are roll formed of sheet metal and include longitudinally extending secondary corrugations 261, and the Z-shaped panels 250 include an outer skin portion 263 and an inner skin portion 264 having a single secondary corrugation 261.

Figure 19:
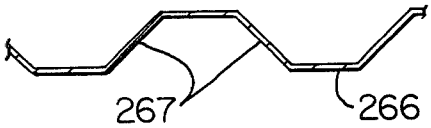
FIG. 19 is a fragmentary section taken generally on the line 19—19 of FIG. 18.

The inner and outer skin portions of each Z-shaped panel 250 are integrally connected by a web portion 266 which is embossed to form laterally extending and longitudinally spaced corrugations 267 as shown in FIG. 19. A series of tray-like spacer members or panels 268 are positioned within each of the primary corrugations 256 at longitudinally spaced intervals and are secured to the outer skin panel 252 and web portions 266 of the panels 250 by fasteners 269. A series of longitudinally spaced and laterally extending tie members 272 are connected to the spacer members 268 by fasteners 273 and to the inner skin panels 254 by fasteners 274, in the same manner as described above in connection with FIG. 16.

Figure 20:
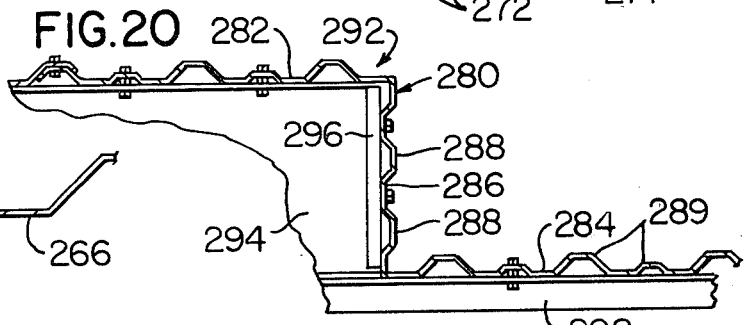
FIG. 20 is a fragmentary section similar to FIG. 18 and showing a further modification of a panel assembly for a single skin panel assembly.

Referring to FIG. 20, a "single skin" panel assembly is constructed of overlapping Z-shaped panels 280 which are roll-formed in a manner similar to that mentioned above in connection with FIG. 16 in that each panel 280 includes an outer skin portion 282 integrally connected to an inner skin portion 284 by a perpendicular wall or web portion 286. In addition, the web portion 286 of each Z-shaped panel 280 includes a series of longitudinally extending secondary corrugations 288 which are roll-formed into the panel along with the outwardly projecting secondary corrugations 289 within the inner and outer skin portions. The assembled panels 280 form the parallel spaced longitudinally extending primary corrugations 292 each of which receives a series of longitudinally spaced spacer members or panels 294. Each of the spacer panels 294 is constructed substantially the same as the spacer panels 224 (FIG. 16) except that each of the panels 294 includes a return lip portion 296. The lip portion 296 increases the strength of the corresponding flange portion of the spacer panel 294 and thereby increases the strength of the web portion 286 of the panel 280. The panels 280 are also rigidly connected by laterally extending tie members 298 in the same manner as the panels 210 are connected by the tie members 232.

Figure 21:
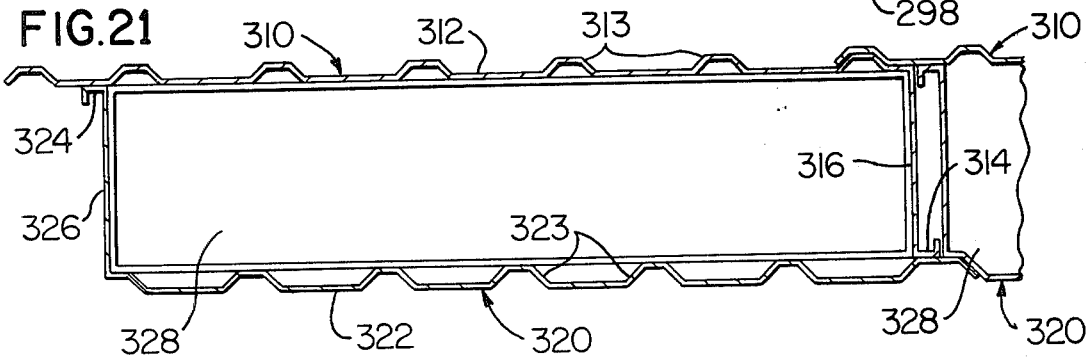
FIG. 21 is a fragmentary section similar to FIG. 17 and showing another modified panel assembly for forming a double skin panel assembly.

Another embodiment of a "double skin" panel assembly is illustrated in FIG. 21. In this embodiment, a roll-formed sheet metal panel 310 includes an outer skin portion 312 having secondary corrugations 313 and integrally connected to an inner skin or flange portion 314 by a web portion 316. Each panel 310 mates with a similarly roll-formed sheet metal panel 320 which includes an inner skin portion 322 having outwardly projecting minor corrugations 323 and integrally connected to an outer skin or flange portion 324 by a web portion 326. Before the panels 310 and 320 are secured together as shown in FIG. 21, a series of longitudinally spaced spacer members or panels 328 are positioned between the panels 310 and 320 and are secured by suitable fasteners (not shown). The spacer members 328 may be installed at the building site when the panels 310 and 320 are progressively assembled or the spacer panels 328 may be preassembled between the panels 310 and 320 when each pair of mating panels 310 and 320 is preassembled at the factory with or without insulation therebetween.

Figure 4:
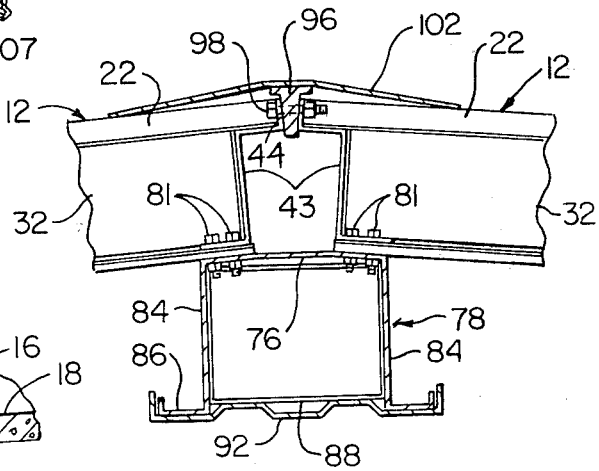
FIG. 4 is an enlarged vertical section through the ridge portion of the building shown in FIG. 1.

From the drawings and the above description, it is apparent that a metal building constructed in accordance with the present invention, provides desirable features and advantages. For example, after the roof panels and wall panels are assembled as described above, the assembled panels have a combined total strength substantially higher than the strength of each panel per se times the number of panels. This higher total strength of the assembled panels results primarily from the transmission of a concentrated load in one panel or group of panels to the laterally adjacent and/or opposing panels through the longitudinally extending ridge beam and eve attachment plates. Furthermore, the coupling of the roof panels across the ridge by means as shown in FIG. 4 or FIG. 12, provides for utilizing the high tensile strength of the inner sheet metal roof skins or skin portions and the high compression strength of the outer roof skins or skin portions for carrying the loads. In addition, as mentioned above, the use of a wedge member compensates for accumulated tolerances in the manufacture and assembly of the roof panels.

Another important feature of a building constructed in accordance with the invention is provided by the coupling of the roof panels to the wall panels by means of the inner attachment members or panels and the outer attachment plates as shown in FIG. 5 or FIG. 10. These attachment members or panels function to transfer the stress or loads from the roof panels to the wall panels and to utilize the inner and outer skin portions of the wall panels to resist bending of the roof panels. Thus the construction and assembly of the roof and wall panels effectively utilize the inherent strength of the sheet metal skin portions of the panels and thereby eliminate the need for a frame and its cost of erection along with the need for roof purlins and wall girts.

Since the sheet metal used for forming the components of the roof panels and wall panels are of substantially lighter gauge, such as 26 gauge, than are commonly used for forming roof purlins and wall girts for a conventional metal building of the same size, the total weight of a building constructed in accordance with the invention is significantly lower than the total weight of a conventional metal building of the same size. As a result, the cost of metal used in constructing a building of the invention is significantly lower than the cost of the metal used in a conventional metal building. The relatively light weight of the roof panels and wall panels, for example, less than 160 pounds for a building having a width of 36 feet, also provides for a simple and quick erection of the building without the need for a crane.

The prefabrication of the roof panels and wall panels also permits quick assembly of the panels, beginning at one end of the building and progressing towards the opposite end. The precise placement of the prepunched holes in the ridge and eave members also assures positive location of the panels and permits erection of the building by labor less skilled than the labor normally required for conventional metal buildings. It is also apparent that the roof panels 12 and wall panels 14 may enclose a thermal insulation material when desired.

With respect to the "single skin" metal panels and building disclosed in connection with FIGS. 9–21, the longitudinally spaced spacer members or panels within the primary corrugations and the continuous horizontal the members cooperate with the corrugated cross-sectional configuration of the panels to provide the assembled panels with a maximum strength/weight ratio. In addition, the Z-shaped panels disclosed in connection with FIGS. 16–21 have several advantages for constructing either a "single skin" or a "double skin" metal building. For example, not only may the elongated Z-shaped panels be roll formed from a common gauge sheet metal such as 26 gauge steel, the Z-shaped panels may be stacked in a compact nesting manner to facilitate storage and shipping. The flexibility of the Z-shaped panel also permits construction of either a "single skin" metal building or a "double skin" metal building and permits the web portion of each Z-shaped panel to be formed with the desired depth according to the size of the metal building.

By reversing the Z-shaped panels end-for-end, the panels may have a prefinished outer surface such as a baked-on enamel coating. Furthermore, the width of the inner skin portion of each Z-shaped wall panel may be conveniently made slightly wider than the corresponding portion of the roof panel so that the roof panels will easily interfit between the side wall panels, as shown in FIG. 9 during erection of the building. As mentioned above in connection with FIG. 17, a metal building constructed with Z-shaped panels may also be provided with higher strength and a generally flush outer surface by simply adding a flat outer skin panel between each pair of adjacent primary corrugations. Similarly, generally flat inner skin panels 246 may be added to provide the roof and/or wall panel assembly with a "double skin" construction and to provide a generally flat inner surface for the panel assemblies.

With respect to FIGS. 9 and 10, it is also within the scope of the invention to stagger the primary corrugations of the roof panels with respect to the primary corrugations of the wall panels so that the inner skin portions 128 and 129 of the wall panels are connected to the outer skin portions 124 of the roof panels, and vice versa, by the members 143 and 147 which interfit between the primary corrugations. In such assembly, the inclined brace panels 152 are also the width of the primary corrugations, and the corresponding spacer members 134 may be omitted so that the brace panels extend between the inner skin portions of the wall panels to the outer skin panels of the roof panels and vice versa, providing the appearance of a continuous brace panel 152.

While the forms of building panels and structures and their methods of construction and assembly herein described constitute preferred embodiments of the invention, it is to be understood that the invention is not limited to these precise forms, and that changes may be made therein without departing from the scope and spirit of the invention as defined in the appended claims.

The invention having thus been described, the following is claimed:

1. A metal building comprising a roof assembly supported by spaced wall assemblies, at least one of said assemblies forming a frameless metal wall or roof for the building and including a series of elongated load bearing structural panels, each of said panels being formed of thin sheet metal bent along parallel spaced longitudinal lines to form a generally flat inner skin portion integrally connected to a generally flat outer skin portion by a generally flat web portion, each said panel having a uniform generally Z-shape cross-sectional configuration to provide for close nesting of individual said panels arranged in a stack, means connecting said outer skin portions of adjacent said panels and connecting said inner skin portions of adjacent said panels with said outer skin portions and said web portions of the connected said panels forming longitudinally extending parallel spaced primary corrugations, said inner and outer skin portions of the assembled said panels having longitudinally extending secondary corrugations forming ribs substantially smaller than said primary corrugations, a plurality of longitudinally spaced spacer members disposed within said primary corrugations between the opposing said web portions and connected to said web portions, each said spacer member extending across the connection of said outer skin portions forming the corresponding said primary corrugation, a plurality of elongated tie members disposed at longitudinally spaced intervals along said assembled panels and extending laterally across said primary corrugations and the connections of said inner skin portions, and means securing each said tie member to said inner skin portions of said assembled panels.

2. A building as defined in claim 1 wherein the assembled said panels comprise said roof assembly and said wall assemblies include horizontally spaced side walls, the assembled said panels sloping upwardly from said side walls to form a ridge, means extending along said ridge and rigidly connecting said outer skin portions of said panels on opposite sides of said ridge and effective to transfer compressive forces therebetween, and means extending along said ridge and rigidly connecting said inner skin portions of said panels on opposite sides of said ridge and effective to transfer tension forces therebetween.

3. A building as defined in claim 2 wherein said connecting means extending along said ridge comprise an elongated ridge beam extending between the roof panel assemblies on opposite sides of said ridge.

4. A building as defined in claim 1 wherein said web portion of each said panel is disposed substantially perpendicular to said inner and outer skin portions of said panel.

5. A metal building as defined in claim 1 wherein said tie members are also secured to said spacer members.

6. A metal building as defined in claim 1 wherein said means connecting said generally flat skin portions of adjacent said panels comprise generally flat elongated panels having longitudinally extending secondary corrugations forming ribs corresponding in size to said ribs on said skin portions.

7. A metal building as defined in claim 1 wherein one of said skin portions of each said panel is slightly wider than the other said skin portion.

8. A metal building comprising a pitched roof assembly supported by spaced vertical wall assemblies, each of said wall assemblies and said roof assembly including a series of elongated load bearing structural panels, each of said panels being formed of thin sheet metal bent along parallel spaced longitudinal lines to form a generally flat inner skin portion integrally connected to a generally flat outer skin portion by a generally flat web portion, each said panel having a uniform generally Z-shape cross-sectional configuration providing for close nesting of individual said panels arranged in a stack, means connecting said outer skin portions of adjacent said panels and connecting said inner skin portions of adjacent said panels with said outer skin portions and said web portions of the connected said panels forming longitudinally extending parallel spaced primary corrugations, said inner and outer skin portions of the assembled said panels having longitudinally extending secondary corrugations forming ribs substantially smaller than said primary corrugations, a plurality of longitudinally spaced spacer members disposed within said primary corrugations between the opposing said web portions and connected to said web portions, said skin portions of said wall panels having upper portions with recesses receiving said web portions and said inner skin portions of said roof panels, said web portions and said skin portions of said wall panels projecting upwardly into corresponding said primary corrugations of said roof panels, and a series of fasteners connecting adjacent said web portions of said roof and wall panels.

9. A metal building comprising a pitched roof assembly supported by generally vertical wall assemblies, said roof assembly and at least one of said wall assemblies each including a plurality of assembled elongated panels, said panels being formed by bent sheets of metal forming substantially flat inner skin portions connected to substantially flat outer skin portions by substantially flat spaced web portions to define parallel spaced and longitudinally extending primary corrugations, said inner and outer skin portions having a plurality of laterally spaced and longitudinally extending secondary corrugations being substantially smaller than said primary corrugations, a plurality of spacer members disposed within said primary corrugations of said panels between said web portions, means securing each said spacer member to said web portions of the corresponding said primary corrugation, said outer skin portions of said wall panels having upper portions with recesses receiving said web portions and said inner skin portions of said roof panels, said web portions and said inner skin portions of said wall panels projecting upwardly into corresponding said primary corrugations of said roof panels, and a series of fasteners connecting adjacent said web portions of said roof and wall panels.

10. A metal building as defined in claim 9 wherein said web portions of said panels forming said roof and wall assemblies, include longitudinally extending secondary corrugations forming ribs.

11. A metal building comprising a pitched roof assembly supported by spaced wall assemblies, at least one of said assemblies forming a frameless metal wall or roof for the building and including a series of elongated load bearing structural panels, each of said panels being formed of thin sheet metal bent along parallel spaced longitudinal lines to form a generally flat inner skin portion integrally connected to a generally flat outer skin portion by a generally flat web portion disposed substantially perpendicular to said skin portions, each said panel having a uniform generally Z-shape cross-sectional configuration to provide for close nesting of individual said panels arranged in a stack, means connecting said outer skin portions of adjacent said panels and connecting said inner skin portions of adjacent said panels with said outer skin-portions and said web portions of the connected said panels forming longitudinally extending parallel spaced primary corrugations, said inner and outer skin portions and said web portions of the assembled said panels having longitudinally extending secondary corrugations forming ribs substantially smaller than said primary corrugations, a plurality of longitudinally spaced spacer members disposed within said primary corrugations between the opposing said web portions and connected to said web portions, each said spacer member extending across the connection of said outer skin portions forming the corresponding said primary corrugation, a plurality of elongated tie members disposed at longitudinally spaced intervals along said assembled panels and extending laterally across said primary corrugations and the connections of said inner skin portions, and means securing each said tie member to said inner skin portions of said assembled panels.

12. A metal building as defined in claim 11 wherein said each of said inner and outer skin portions has only three of said longitudinally extending secondary corrugations and each of said web portions has only two of said longitudinally extending secondary corrugations.

* * * * *